US006414566B1

(12) United States Patent
Atokawa

(10) Patent No.: US 6,414,566 B1
(45) Date of Patent: Jul. 2, 2002

(54) FREQUENCY-CHARACTERISTICS VARIABLE FILTER, DUPLEXER, AND COMMUNICATION APPARATUS

(75) Inventor: Masayuki Atokawa, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/585,201

(22) Filed: Jun. 1, 2000

(30) Foreign Application Priority Data

Jun. 2, 1999 (JP) ..... 11-154762

(51) Int. Cl.[7] ..... H01P 1/20
(52) U.S. Cl. ..... 333/134; 333/103
(58) Field of Search ..... ; H01P 1/20

(56) References Cited

U.S. PATENT DOCUMENTS 5,594,394 A * 1/1997 Sasaki et al. ..... 333/103
5,627,502 A * 5/1997 Ervasti ..... 333/134
6,085,071 A * 7/2000 Yamada et al. ..... 455/82

FOREIGN PATENT DOCUMENTS

JP 10-150304 A * 6/1998 ..... H01P/1/205

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A frequency-characteristics variable filter, a duplexer, and a communication apparatus that can be operated at reduced bias voltages that are applied to diodes provided for switching frequency characteristics without reducing the stability of frequency characteristics and without increasing the occurrence of skews. Also, the single duplexer can be used for two frequency bands. As a diode for each of resonators in a transmitting filter and the first resonator in a receiving resonator, a diode having an interterminal electrostatic capacitance in the off state smaller than that of a diode used for other resonators is used. Also, the diodes for the resonators excluding the first resonator in the receiving filter has a lower forward resistance in the on state and an Q value in the off state higher than those of other diodes.

9 Claims, 3 Drawing Sheets

FREQUENCY-CHARACTERISTICS VARIABLE FILTER, DUPLEXER, AND COMMUNICATION APPARATUS

BACKGROUND OF THE INVENTION

1. Field of the Invention

The present invention relates to a filter and a duplexer in which frequency-characteristics are variable, and a communication apparatus using at least one of them.

2. Description of the Related Art

A frequency-characteristics variable filter was suggested as disclosed in Japanese Unexamined Patent Application Publication No. 7-321509. In the suggested frequency-characteristics variable filter, reactance elements such as capacitors are connected to resonators via individual diodes, and voltages applied to the diodes are controlled, thereby varying resonant frequencies of resonators.

With a PIN diode used for each of the aforementioned diodes, the resonant frequency is switched between ON and OFF states, thereby providing two bands as frequency characteristics of the filter. Normally, when the PIN diode is in the ON state, a positive bias voltage is applied; and when the PIN diode is in the OFF state, a negative bias voltage is applied.

However, in a duplexer configured of the above-described frequency-characteristics variable filters, problems arise as described below.

With the above-described filter used for a transmitting filter, since a high power is inputted to the diode switch, the PIN diode switch having a high power-withstanding characteristic is used. When a high power is inputted to the transmitting filter, in addition to a serial bias voltage applied to a control terminal, a radio-frequency (RF) voltage is applied to each end of the diode switch. Therefore, generally, a high negative bias voltage of about −20 V must be applied thereto so that the diode switch can be maintained in a stable OFF state even when the diode switch receives a high transmitting-wave power in the OFF state.

However, a small and battery-driven apparatus, such as a portable telephone terminal, is required to be controlled using a negative power source with the lowest-possible voltage (with the smallest-possible absolute voltage value). A power in a range of 1 to 3 W is applied to a transmitting filter of the portable telephone terminal for transmission. However, when a low negative bias voltage of, for example, about −3 V is applied to a diode switch in the transmitting filter, problems arise. The problems are that an interterminal electrostatic capacitance of the diode in the OFF state varies, frequency characteristics of the transmitting filter also varies, and in addition, the transmitting signal is skewed.

In a receiving filter of the portable telephone terminal, normally, a high power as in the case of the transmitting filter is not inputted. However, in a transmitting filter configured such that received signals are inputted from an antenna port commonly used for transmitting and receiving signals, a small amount of an RF voltage is applied from the transmitting side to the first resonator of the receiving filter. For this reason, when a low negative bias voltage is applied thereto, the frequency characteristics of the filter vary. In the unstable state where the interterminal electrostatic capacitance is large, two waves, that is, a transmitted wave and a disturbing wave from the antenna frequently cause intermodulation skews.

SUMMARY OF THE INVENTION

To overcome the above described problems, preferred embodiments of the present invention provide a filter and a duplexer in which the frequency-characteristics are variable, and a communication apparatus that can be operated at reduced bias voltages applied to diodes provided for switching frequency characteristics without reducing the stability of frequency characteristics and without increasing the occurrence of skews.

One preferred embodiment of the present invention provides a frequency-characteristics variable filter comprising: a plurality of resonators; a plurality of reactance elements respectively connected to the plurality of resonators via diodes; at least two types of the diodes having different characteristics corresponding to applied radio-frequency voltages.

According to the above, the diodes appropriate to the applied RF voltages are used. Therefore, frequency characteristics can be stably and surely switched without being influenced by characteristics of the diodes.

In the above described frequency-characteristics variable filter, the characteristics of each of the diodes may be characteristics of an interterminal electrostatic capacitance corresponding to the applied voltage. For example, for the diode to which a high radio-frequency (RF) voltage is applied, a diode having a small interterminal electrostatic capacitance is used. By this, even with a low bias voltage for turning off the diode, variation in the interterminal electrostatic capacitance of the diode can be reduced. This allows stable frequency characteristics and skew-reducing characteristics to be obtained.

Another preferred embodiment of the present invention provides a duplexer, wherein: the duplexer comprises two frequency-characteristics variable filters each comprising at least one resonators and at least one reactance elements connected to the at least one resonators via at least one diodes; one of the frequency-characteristics variable filters is a transmitting filter and the other one of the frequency-characteristics variable filters is a receiving filter; and at least one of the diodes in the transmitting filter has an interterminal electrostatic capacitance in the off state, the interterminal electrostatic capacitance being smaller than that of the diode connected to the resonators in the receiving filter excluding the resonator of a first stage.

According to the above, since the single duplexer can be used for two frequency bands, the overall miniaturization can be implemented. In addition, even with low bias voltages for turning off the diodes, reduction can be achieved for variation in the interterminal electrostatic capacitance when RF voltages as transmitting waves are applied to the transmitting filter. This allows stable frequency characteristics and skew-reducing characteristics to be obtained. Therefore, the duplexer can be suitably and easily used for small communication apparatuses, such as portable telephone terminals, which are driven by a low-voltage power source.

Yet another preferred embodiment of the present invention provides a duplexer, wherein: the duplexer comprises two frequency-characteristics variable filters each comprising at least one resonators and at least one reactance elements connected to the at least one resonators via at least one diodes; one of the frequency-characteristics variable filters is a transmitting filter and the other one of the frequency-characteristics variable filters is a receiving filter; and at least one of the diodes connected to the resonator of a first stage in the receiving filter has an interterminal electrostatic capacitance in the off state, the interterminal electrostatic capacitance being smaller than that of one of the diodes connected to the resonators in the receiving filter excluding the resonator of a first stage.

According to this, even with low bias voltages for turning off the diodes in the receiving filter, reduction can be achieved for variation in the interterminal electrostatic capacitance. Also, intermodulation skews occurring when a disturbing wave intrudes from the transmitting side into the first resonator of the receiving filter can be minimized.

In the above described duplexer, the interterminal electrostatic capacitance may be about 0.7 pF or less when an interterminal voltage of the diode is 0 V.

According to this, even with a voltage of the negative power source that applies reverse bias voltage to the diode, for example, with 0 V, frequency variations due to transmitting waves do not cause problems in the practical use. Therefore, the frequency characteristics of the filter can be switched using a negative power source that has a negative voltage represented by a small absolute value.

Yet another preferred embodiment of the present. invention provides a duplexer, wherein: the duplexer comprises two frequency-characteristics variable filters each comprising at least one resonators and at least one reactance elements connected to the at least one resonators via at least one diodes; one of the frequency-characteristics variable filters is a transmitting filter and the other one of the frequency-characteristics variable filters is a receiving filter; and one of the diodes connected to the resonators in the receiving filter excluding the resonator of a first stage has a forward resistance value smaller than that of each of the diodes connected to the resonators in the transmitting filter, and has an Q value in the off state higher than that each of the diodes connected to the resonators in the transmitting filter.

As described above, with the diodes provided at least for the resonators excluding the first resonator in the receiving filter, to which RF voltages as transmitting waves are not applied, no problems arise in variation in the interterminal electrostatic capacitance because of the application of the RF voltages. Therefore, loss can be reduced by using diodes each having the low forward resistance in the on state, and a high Q value in the off state of the interterminal electrostatic capacitance can be obtained.

In this way, losses at least due to the diodes provided for the resonators excluding the first resonator can be reduced. Also, since switching diodes for small signals can be used instead of PIN diodes, costs can be reduced.

Yet another preferred embodiment of the present invention provides a communication apparatus comprising either the above described filter or the above described duplexer. By this arrangement, communication with stable frequency characteristics can be performed in different frequency bands, and also, the small and low-loss type communication apparatus can be obtained.

Other features and advantages of the present invention will become apparent from the following description of the invention which refers to the accompanying drawings.

DESCRIPTION OF THE PREFERRED EMBODIMENTS

Hereinbelow, referring to FIGS. 1 to 4, a description will be given of configurations of embodiments of a duplexer and a communication apparatus according to the present invention.

Figure 1:
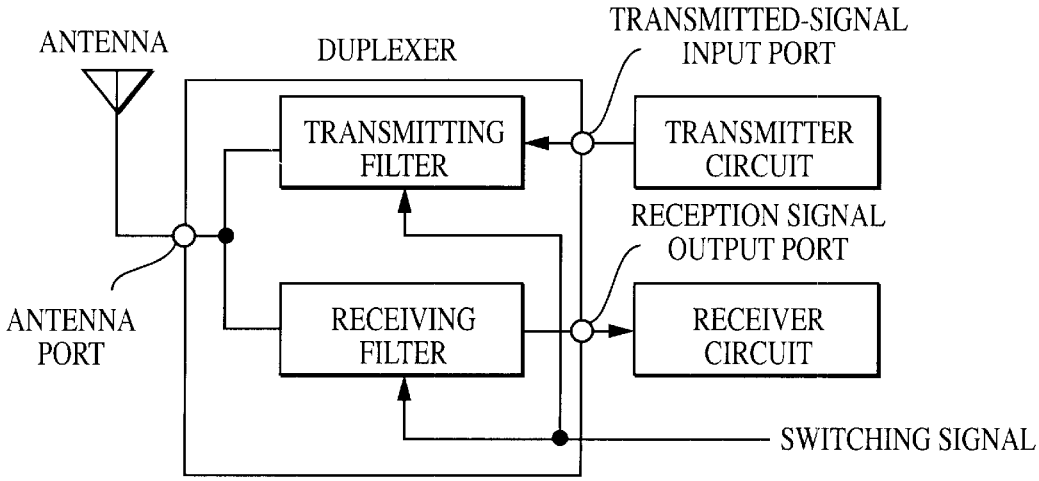
FIG. 1 is a schematic view of embodiments of a duplexer and a communication apparatus using the duplexer.

FIG. 1 is a schematic view of the duplexer and the communication apparatus that uses the duplexer. The communication apparatus is employed in a communication system that divides the frequency band of each transmitted signal and each received signal into two frequency bands, that is, the high frequency band and the low frequency band, for using the signals. According to a switching signal, a transmitting filter in the duplexer allows one of the high and low bands of the transmitting frequency band to pass. Similarly, a receiving filter in the duplexer allows one of the high and low bands of the receiving frequency band to pass. The duplexer has an antenna port connected to an antenna, at which phases of the transmitting filter and the receiving filter are synthesized. Also, the duplexer has a transmitted-signal input port connected to a transmitter circuit, and a received-signal output port connected to a receiver circuit. Thus, a radio-frequency (RF) circuit of the communication apparatus is configured.

Figure 2:
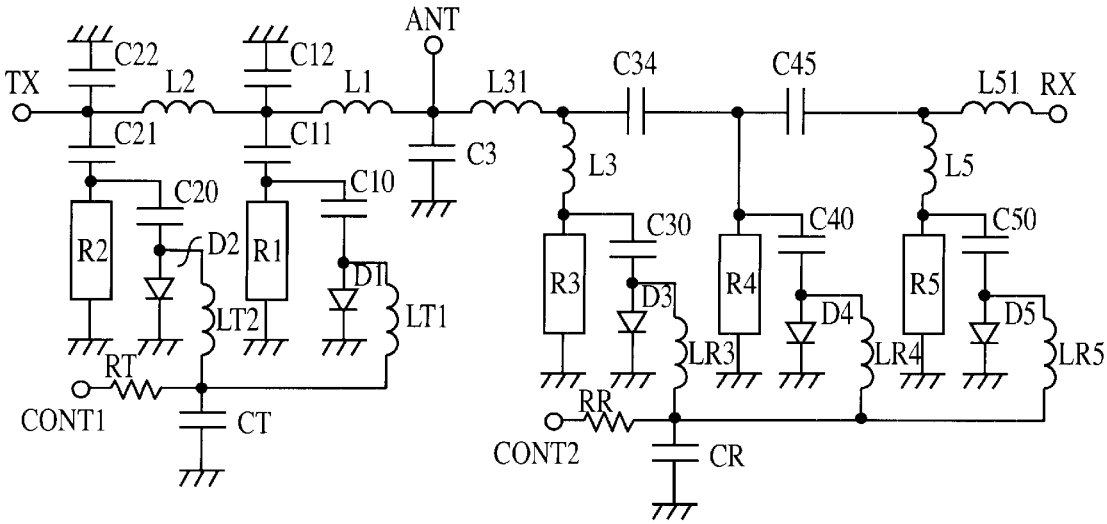
FIG. 2 is a circuit diagram of the duplexer shown in FIG. 1.

FIG. 2 is a circuit diagram of the duplexer described above. TX denotes the transmitted-signal input port, RX denotes the received-signal output port, and ANT denotes the antenna port. Also, CONT1 denotes a control-signal input terminal for transmitted signals, and CONT2 denotes a control-signal input terminal for received signals. An application voltage for each of these control terminals is the switching signal shown in FIG. 1. Switching of the application voltage switches between frequency characteristics of the transmitting filter and frequency characteristics of the receiving filter.

In FIG. 2, one end of each of resonators R1 and R2 is directly grounded. The other end of the resonator R1 is grounded via capacitors C11 and C12. Similarly, the other end of the resonator R2 is grounded via capacitors C21 and C22. Between the grounded points, an inductor L2 is connected. Thus, a bandpass elimination filter (BEF) is configured. In the BEF, resonant frequencies of the resonators R1 and R2 are individually used as attenuation poles.

One end of each of resonators R3 to R5 is directly grounded. The other end of each of the resonators R3 to R5 is connected to each other via capacitors C34 and C45 and inductors L3 and L5. Thus, a bandpass filter (BPF) is configured of the three resonators R3 to R5. At an input section of this receiving filter, an inductor L51 is provided.

Inductors L1 and L31 and a capacitor C3 configure a phase-synthesizer circuit. The phase-synthesizer circuit prevents the intrusion of transmitted signals into the receiving filter. It also prevents the intrusion of received signals to the transmitting filter. Thus, the phase-synthetic circuit separates signals into transmitting signals and received signals.

In the transmitting filter, a serial circuit formed of a diode D1 and a capacitor 10 is formed between the end and the grounded point of the resonator R1. A serial circuit formed of a diode D2 and a capacitor 20 is formed between the end and the grounded point of the resonator R2. An RF-blocking circuit formed of an inductor LT1, a resistor RT, and a capacitor CT is provided between the control-signal input terminal CONT1 and the diode D1. An RF-blocking circuit formed of an inductor LT2, the resistor RT, and the capacitor CT is provided between the control-signal input terminal CONT1 and the diode D2.

Similarly, in the receiving filter, a serial circuit formed of a diode D3 and a capacitor 30 is formed between the end and the grounded point of the resonator R3. A serial circuit formed of a diode D4 and a capacitor 40 is formed between the end and the grounded point of the resonator R4. A serial circuit formed of a diode D5 and a capacitor 50 is formed between the end and the grounded point of the resonator R5. An RF-blocking circuit formed of an inductor LR3, a resistor RR, and a capacitor CR is provided between the control-signal input terminal CONT2 and the diode D3. An RF-blocking circuit formed of an inductor LR4, the resistor RR, and the capacitor CR is provided between the control-signal input terminal CONT2 and the diode D4. An RF-blocking circuit formed of an inductor LR5, the resistor RR, and the capacitor CR is provided between the control-signal input terminal CONT2 and the diode D5.

As described above, the diode D3 is connected to the diodes D1 and D2 that are provided for the resonators R1 and R2, respectively, in the transmitting filter and to the first resonator R3 in the receiving filter. The diode D3 thus provided is a PIN diode that has the interterminal electrostatic capacitance of 0.4 pF when each bias voltage is 0 V. On the other hand, however, the diodes D4 and D5 provided for the resonators other than the first resonator in the receiving filter are not PIN diodes, but they are switching diodes dedicated for small signals. Each of the diodes D4 and D5 has a lower forward resistance in the on state than in the case of the diodes D1 to D3. It also has a higher $Q_0$ value in the off state in the interterminal electrostatic capacitance than in the case of the diodes D1 to D3.

In the state shown in FIG. 2, in response to a predetermined positive voltage applied to the control-signal input terminal CONT1, the diodes D1 and D2 become conductive, and the capacitors 10 and 20 are substantially parallel-connected to the resonators R1 and R2, respectively. Thereby, individual resonant frequencies of the resonators R1 and R2 decrease. When the application voltage to the control-signal input terminal CONT1 is reduced to 0 V, the diodes D1 and D2 are blocked. Therefore, the capacitors 10 and 20 are disconnected from the resonators R1 and R2, respectively, thereby increasing the resonant frequencies of the resonators R1 and R2.

Similarly, in the receiving filter, in response to a predetermined positive voltage applied to the control-signal input terminal CONT2, the diodes D3, D4, and D5 become conductive, and the capacitors C30, C40, and C50 are substantially parallel-connected to the resonators R3, R4, and R5, respectively. Thereby, individual resonant frequencies of the resonators R3, R4, and R5 decrease. When the application voltage to the control-signal input terminal CONT2 is reduced to 0 V, the diodes D3, D4, and D5 are blocked. Therefore, the capacitors C30, C40, and C50 are disconnected from the resonators R3, R4, and R5, respectively; thereby increasing the resonant frequencies of the resonators R3, R4, and R5 increase.

Figure 3:
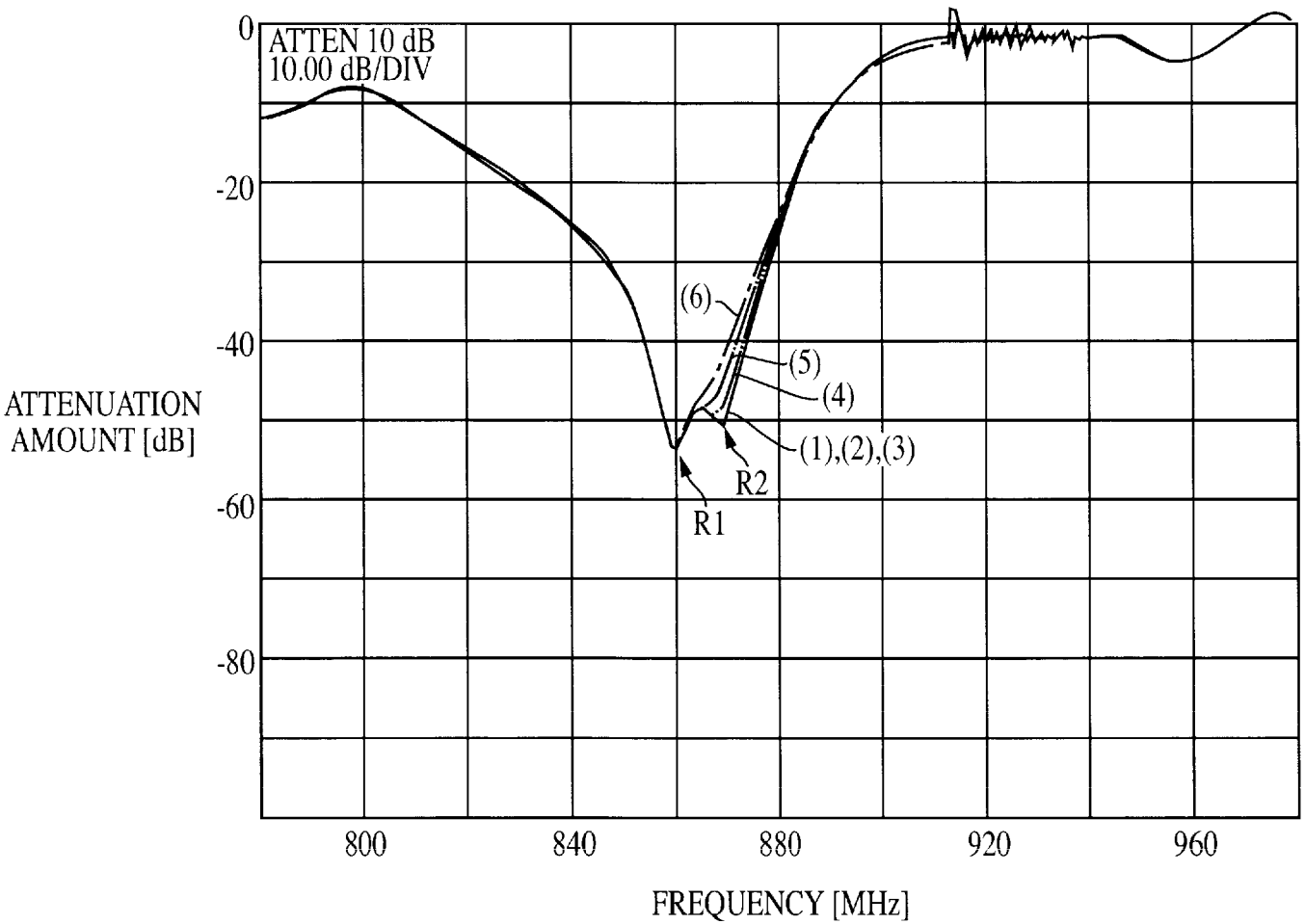
FIG. 3 is a graph showing bandpass characteristics of a transmitting filter.

FIG. 3 shows bandpass characteristics of the transmitting filter. In this, the PIN diodes each having the interterminal electrostatic capacitance of 0.4 pF are used for the described diodes D1 and D2. As an example for comparison, FIG. A shows bandpass characteristics of a transmitting filter in which PIN diodes each having the interterminal electrostatic capacitance of 1.0 pF are used for diodes corresponding to the described diodes D1 and D2. In each of the figures, the attenuation poles indicated by R1 an R2 are attributed to resonance. The band according to the two attenuation poles is the received frequency band.

Figure 4:
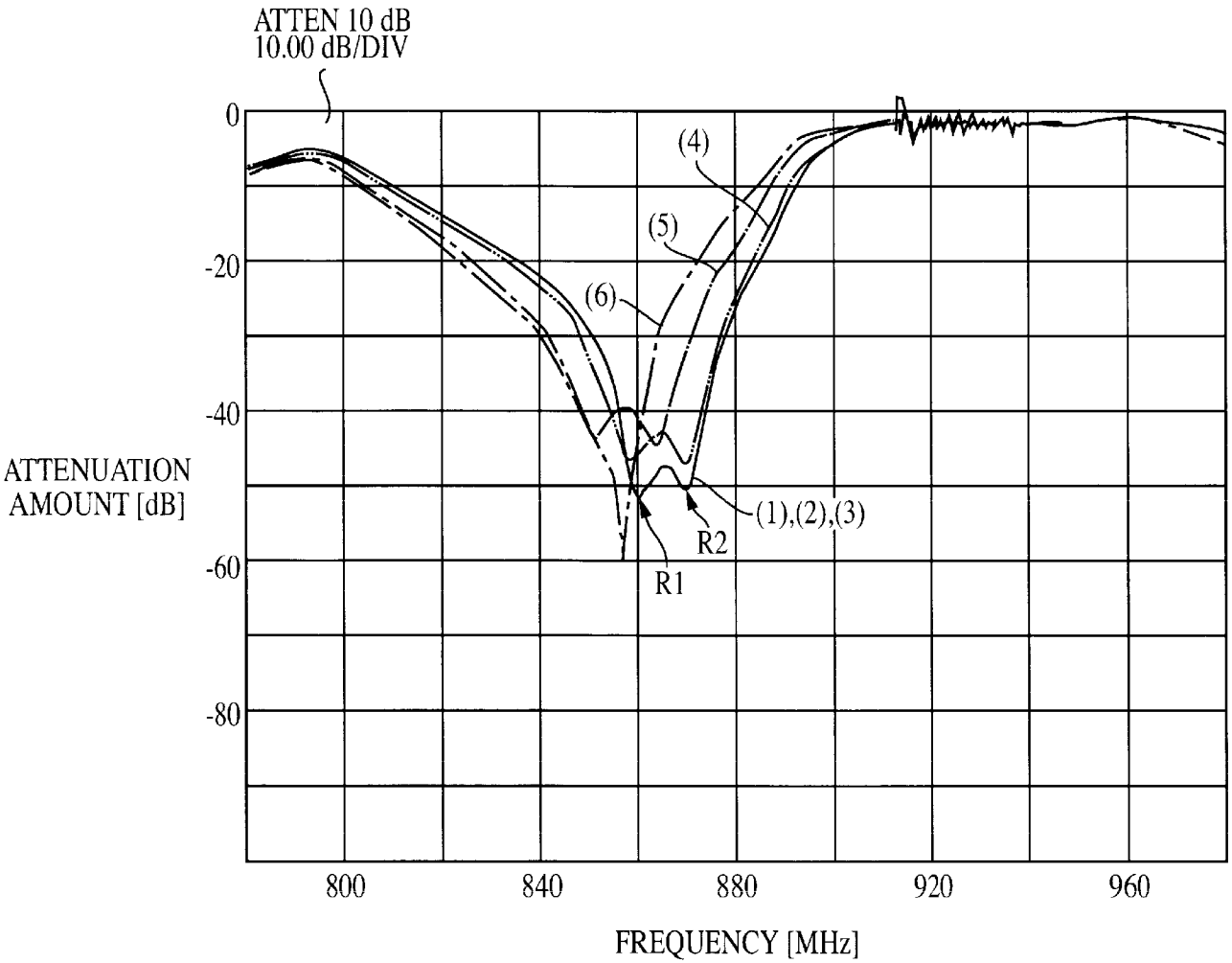
FIG. 4 is a graph showing example bandpass characteristics of a transmitting filter for comparison.

In FIGS. 3 and 4, line curves (1) to (6) indicate characteristics when the transmitting-wave power is switched in six levels. In FIG. 3, the line curves (1) to (6) individually indicate characteristics at the following power levels: (1) very low, (2) 21.3 dBm, (3) 24.0 dBm, (4) 27.2 dBm, (5) 30.1 dBm, and (6) 33.0 dBm. Similarly, in FIG. 4, the line curves (1) to (6) individually indicate characteristics at the following power levels: (1) very low, (2) 20.8 dBm, (3) 23.8 dBm, (4) 27.1 dBm, (5) 30.0 dBm, and (6) 33.0 dBm.

As shown in FIG. 3, with the diode having the interterminal electrostatic capacitance of 0.4 pF, even when the transmitting-wave power is increased from the very low level up to 33.0 dBm, almost no variation occurs in attenuation pole frequencies of the resonators R1 and R2 of the transmitting filter. Therefore, the receiving frequency band can be attenuated to a predetermined level.

With the diode having the large interterminal electrostatic capacitance of 1.0 pF, however, as shown by the line curves (4) to (6), when the transmitting-wave power exceeds 27.1 dBm, the interterminal electrostatic capacitance significantly varies, thereby causing the frequencies in the attenuation range to significantly deviate.

In the examples shown in FIGS. 3 and 4, characteristic variations only in the transmitting filter are shown. However, similar variations occur in the receiving filter. That is, when the interterminal electrostatic capacitance of the diode D3 provided in the first resonator is large, the interterminal electrostatic capacitance of the first resonator varies corresponding to the bandpass characteristics of the transmitting wave, thereby varying the bandpass characteristics.

Also, the examples show only the individual cases where the interterminal electrostatic capacitances of the diodes are 0.4 pF and 1.0 pF. However, at the transmitting power of 3 W, it was already verified that the frequency variation according to inputted transmitting wave does not arise any problems that cause reverse effect in the practical application in a range of the interterminal electrostatic capacitance in the transmitting filter up to 0.7 pF.

As has been described, the interterminal electrostatic capacitance of the diode used for the resonator to which a high transmitting-wave power is applied is reduced. Thereby, even with a voltage of the negative power source that applies reverse bias voltage to the diode, for example, with 0 V, the duplexer can be operated without problems. On the other hand, resistance values in the on state of the diodes D4 and D5 provided in the second and third resonators R4 and R5 are low. Also, Q values in the off state of the interterminal electrostatic capacitances of the diodes D4 and D5 are high. Therefore, power loss that can be caused by the diodes D4 and D5 is small, thereby allowing reduction in the Q values of the resonators R4 and R5. Accordingly, insertion loss due to the filter can also be reduced.

As above, although the present invention has been described referring to the embodiment shown in figures, it is not restricted thereto. On the contrary, the present invention is intended to cover various other modifications and equivalent arrangements within the spirit and scope of the invention.

What is claimed is:

1. A duplexer, wherein:

the duplexer comprises two frequency-characteristics variable filters each comprising at least one resonator and at least one reactance element connected to the at least one resonator via at least one diode;

one of the frequency-characteristics variable filters is a transmitting filter and the other one of the frequency-characteristics variable filters is a receiving filter; and the at least one diode in the transmitting filter has an interterminal electrostatic capacitance in the off state, the interterminal electrostatic capacitance being smaller than that of the diode connected to the at least one resonator in the receiving filter excluding the resonator of a first stage.

2. The duplexer according to claims 1, wherein the interterminal electrostatic capacitance is about 0.7 pF or less when an interterminal voltage of the diode is 0 V.

3. A communication apparatus comprising the duplexer of claim 1.

4. A duplexer, wherein:

the duplexer comprises two frequency-characteristics variable filters each comprising at least one resonator and at least one reactance element connected to the at least one resonator via at least one diode;

one of the frequency-characteristics variable filters is a transmitting filter and the other one of the frequency-characteristics variable filters is a receiving filter; and at least one diode connected to the resonator of a first stage in the receiving filter has an interterminal electrostatic capacitance in the off state, the interterminal electrostatic capacitance being smaller than that of another one of the diodes connected to a resonator in the receiving filter excluding the resonator of the first stage.

5. A communication apparatus comprising the duplexer of claim 4.

6. The duplexer according to claims 4, wherein the interterminal electrostatic capacitance is about 0.7 pF or less when an interterminal voltage of the diode is 0 V.

7. A duplexer, wherein:

the duplexer comprises two frequency-characteristics variable filters each comprising at least one resonator and at least one reactance element connected to the at least one resonator via at least one diode;

one of the frequency-characteristics variable filters is a transmitting filter and the other one of the frequency-characteristics variable filters is a receiving filter; and the at least one diode connected to the at least one resonator in the receiving filter excluding the resonator of a first stage has a forward resistance value smaller than that of the at least one diode connected to the at least one resonator in the transmitting filter, and has a Q value in the off state higher than that of the at least one diode connected to the at least one resonator in the transmitting filter.

8. A communication apparatus comprising the duplexer of claim 7.

9. A communication apparatus comprising a frequency-variable characteristics filter, said filter comprising:

a plurality of resonators; and a plurality of reactance elements respectively connected to the plurality of resonators via corresponding diodes; said diodes including at least two types of diodes having different respective characteristics including different interterminal electrostatic capacitances corresponding to an applied radio-frequency voltage.

* * * * *